US006302299B1

(12) United States Patent
Baker et al.

(10) Patent No.: US 6,302,299 B1
(45) Date of Patent: Oct. 16, 2001

(54) BULK FOUNTAIN SYRUP DELIVERY AND STORAGE SYSTEM

(75) Inventors: Bradley P. Baker, Alpharetta; Kelli Jo Morley, Roswell; Orlando Arjona, Acworth; Richard B. Schultz; Alva Claude Cobb, both of Marietta, all of GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/293,317

(22) Filed: Apr. 16, 1999

(51) Int. Cl.[7] ..... B67D 5/56
(52) U.S. Cl. ..... 222/105; 222/129.1
(58) Field of Search ..... 222/105, 129.1, 222/183, 131, 144.5; 141/349

(56) References Cited

U.S. PATENT DOCUMENTS

| | | | |
|---|---|---|---|
| 3,057,517 | 10/1962 | Douglas | 222/1 |
| 4,113,146 | 9/1978 | Williamson | 222/105 |
| 4,165,024 | 8/1979 | Oswalt et al. | 222/105 |
| 4,256,150 | 3/1981 | Möckesch | 141/5 |
| 4,421,253 | 12/1983 | Croley | 222/105 |
| 4,445,539 | 5/1984 | Credle | 137/614.03 |
| 4,480,766 | 11/1984 | Platt | 222/105 |
| 4,585,146 | 4/1986 | Richter | 222/1 |
| 4,586,628 | 5/1986 | Nittel | 220/470 |
| 4,596,040 | 6/1986 | LaFleur et al. | 383/7 |
| 4,683,921 | 8/1987 | Neeser | 141/1 |
| 4,753,370 * | 6/1988 | Rudick | 222/105 |
| 4,901,886 | 2/1990 | Kirschner | 222/1 |
| 4,911,212 | 3/1990 | Burton | 141/369 |
| 5,115,943 | 5/1992 | Coleman | 222/94 |
| 5,163,587 | 11/1992 | Apps et al. | 222/105 |
| 5,174,354 | 12/1992 | Neeser et al. | 141/5 |
| 5,215,128 | 6/1993 | Neeser | 141/59 |
| 5,234,035 | 8/1993 | Neeser | 141/1 |
| 5,263,613 | 11/1993 | Billings | 222/129.1 |
| 5,282,550 * | 2/1994 | Coleman | 222/105 |
| 5,356,029 | 10/1994 | Hogan | 220/465 |
| 5,375,741 | 12/1994 | Harris | 222/105 |
| 5,402,915 | 4/1995 | Hogan | 222/105 |
| 5,477,883 | 12/1995 | Totten | 137/614.03 |
| 5,555,996 | 9/1996 | Lang-Ree et al. | 220/403 |
| 5,586,589 * | 12/1996 | Voelker | 141/349 |
| 5,634,572 | 6/1997 | Lane, Jr. et al. | 222/95 |

FOREIGN PATENT DOCUMENTS

| | | |
|---|---|---|
| 3436053 A1 | 2/1984 | (DE) . |
| 2411318 | 11/1977 | (FR) . |
| 1200296 | 9/1966 | (GB) . |
| WO 91/10615 | 1/1991 | (GB) . |

* cited by examiner

*Primary Examiner*—Philippe Derakshani
(74) *Attorney, Agent, or Firm*—Sutherland Asbill & Brennan LLP

(57) ABSTRACT

An improved bulk storage system for fluids supplied to a dispensing system by a fluid line. The bulk storage system includes a receptacle with a first portal and a second portal. A substantially nonpermeable bag is positioned within the receptacle for storing and dispensing fluids therefrom. The bag includes a first passageway positioned adjacent to the first portal of the receptacle and a second passageway positioned adjacent to the second portal of the receptacle. A support device is positioned adjacent to the receptacle. The first passageway of the bag is attached to the support device and the second passageway of the bag is attached to the fluid line such that fluids in the bag flow through the second passageway to the dispensing system.

49 Claims, 4 Drawing Sheets

BULK FOUNTAIN SYRUP DELIVERY AND STORAGE SYSTEM

TECHNICAL FIELD

The present invention relates to a bulk delivery and storage system for fluids and more particularly relates to a bulk storage device for soft drink syrup and a method for delivering and storing the same.

BACKGROUND OF THE INVENTION

Soft drink beverage dispensers, also known as soft drink fountains, mix soft drink concentrate, such as syrup, with a diluent, such as soda water. The typical soft drink fountain is capable of dispensing several different beverages or beverage flavors, either through a common nozzle assembly or through separate dispensing taps. In either case, the fountain draws in syrup from one or more syrup sources.

The syrup may be provided to a fountain customer in a number of different formats. Conventional methods include delivering the syrup in a disposable five (5) gallon "bag in box" ("BIB") container or in a reusable five gallon tank. The bag in box container or the reusable tank provides the syrup to the fountain by a flexible hose or other types of connectors. Typically, a third party distributor delivers the syrup container to a customer while also delivering food items and condiments.

Another known method is to use refillable syrup receptacles located near the fountains. High volume customers may install bulk syrup receptacles of about 75 gallons or more to reduce the frequency of changing the syrup containers. These receptacles may be 75 gallon stainless steel pressure tanks. The receptacles are periodically filled via a tanker truck of some sort or by similar types of delivery means in 75 gallon increments. Such high volume customers may have several receptacles on the premises to insure a steady supply of syrup. Typically, there are two (2) receptacles per type or flavor of syrup at an outlet.

One drawback with known syrup receptacle designs is that the receptacles generally must be washed out and cleaned before each refilling. This cleaning process can be time consuming and may result in unacceptable down time for the customer. One or more fountain dispensers may be unavailable while the receptacles are being cleaned and filled. Further, because the customer may not want to have the receptacles cleaned at busy times of the day, delivery times and schedules may be complicated to arrange.

Another drawback is that the syrup receptacles may be inadvertently filled with the wrong type or flavor of syrup. Alternatively, the hoses running between the fountain and the receptacles may be inadvertently hooked up in the wrong order. In either case, the fountain may dispense the wrong type of beverage. Although the substitution of certain beverages may be readily apparent, i.e., a clear beverage for a dark colored beverage, other substitutions would not be as readily apparent to the customer.

Other drawbacks include the fact that known bulk syrup receptacles are generally dedicated to one type or flavor of syrup to ensure consistent taste. A customer therefore may not be able to vary easily the types of beverages offered. The receptacles are also costly to install and may take up more space than the same volume of BIB containers.

What is needed, therefore, is a simplified bulk syrup delivery, storage, and dispensing system that avoids the need for cleaning the syrup receptacles after each use, that avoids the down time common in the use of such syrup receptacles, and that prevents the inadvertent substitution of beverages. These goals must be accomplished in a reliable and low cost manner.

SUMMARY OF THE INVENTION

The present invention provides an improved bulk storage system for fluids supplied to a dispensing system by a fluid line. The bulk storage system includes a receptacle with a first portal and a second portal. A substantially nonpermeable bag is positioned within the receptacle for storing and dispensing fluids therefrom. The bag includes a first passageway positioned adjacent to the first portal of the receptacle and a second passageway positioned adjacent to the second portal of the receptacle. A support device is positioned adjacent to the receptacle. The first passageway of the bag is attached to the support device and the second passageway of the bag is attached to the fluid line such that fluids in the bag flow through the second passageway to the dispensing system.

Specific embodiments of the present invention include using a receptacle having an outer shell with a first end and a second end. The first portal includes this first end of the outer shell. The second end of the receptacle includes a bottom plate with a central drain. The second portal includes this central drain positioned within the bottom plate. The receptacle may be stainless steel, plastic, or a combination of the two.

The bag may be a flexible material such as linear low density polyethylene. The first passageway of the bag may include a spout attached to the bag and a hose connected to the spout or an extended bag section. The second passageway of the bag may include a spout. The bag may have a predetermined color. The color depends upon the type of fluid intended to be contained in the bag. The receptacle and the fluid line also may have this predetermined color.

The support device may include a manifold having a first valve and a second valve in fluid communication with each other. The first passageway of the bag may be attached to the second valve of the manifold such that fluids flowing through the first valve of the manifold pass through the second valve and the first passageway into the bag.

The first passageway of the bag may include a first passageway connector having a predetermined size. The second valve of the manifold also may include a manifold connector with this predetermined size. The predetermined size varies with the type of fluid intended to be placed in the bag. The second passageway of the bag also may include a passageway connector of a predetermined size. The fluid line also may include a line connector with this predetermined size. This predetermined size also varies with the type of fluid intended to be dispensed from the bag.

The present invention may further include a delivery system for providing fluids to the bag through the first passageway. The delivery system may include a delivery vehicle with a plurality of fluid compartments and a delivery hose for providing fluids from the plurality of fluid compartments to the bag. The support device may have a manifold such that the delivery hose and the first passageway of said bag are connected in fluid communication therethrough. The delivery hose may include a delivery hose connector of a predetermined size. The manifold also may include a manifold connector of the same predetermined size. The predetermined size again varies with the type of fluid intended to be delivered to the bag. The delivery hose also may have a predetermined color depending upon the type of fluid intended to be placed in the bag.

The method of the present invention provides for use of a storage receptacle with a beverage dispenser. A fluid line connects the storage receptacle and the beverage dispenser. The method includes the steps of placing a flexible bag with a first spout and a second spout within the storage receptacle; attaching the second spout to the fluid line; supplying fluids to the bag through the first spout; evacuating fluids from the bag to the beverage dispenser through the second spout and the fluid line; and removing the bag from the receptacle when the bag is exhausted. The fluid may be soft drink syrup. The receptacle may further include a manifold positioned adjacent thereto. The method then further includes the steps of attaching the first spout to the manifold and supplying fluids to the bag therethrough.

A further method of the present invention provides for using a plurality of color-coded storage receptacles for supplying syrup to a beverage dispenser. Each of the receptacles is to be lined with one of a plurality of color-coded bags and connected to the beverage dispenser by one of a plurality of color-coded fluid lines. The method includes the steps of selecting one of the color-coded receptacles; selecting one of the color-coded bags to match the receptacle; placing the color-coded bag within the color-coded receptacle; filling the bag with fluid; selecting one of the color-coded fluid lines to match the receptacle and the bag; connecting the bag to the fluid line; and supplying syrup to the beverage dispenser. The method may further a delivery vehicle with a plurality of fluid compartments and a plurality of color-coded delivery hoses. The method then further included the steps of selecting one of the colorcoded delivery hoses to match the receptacle and the bag; connecting the delivery hose to the bag; and delivering syrup to the bag.

A further method of the present invention provides for supplying fluids from a delivery source to a plurality of storage receptacles. The method includes the step of supplying each one of the storage receptacles with one of a plurality of bag liners. Each one of the bag liners includes one of a plurality of bag connectors. Each one of the bag connectors includes a predetermined dimension determined by the type of fluid to be placed within the bag liner. The method further includes the step of supplying the delivery source with a plurality of delivery hoses. Each one of the delivery hoses includes one of a plurality of hose connectors. Each one of the hose connectors has a predetermined dimension determined by the bag connector intended to be used therewith. The method further includes the steps of selecting the bag liner within one of the receptacles to be joined with one of the delivery hoses; connecting the bag liner with the delivery hose; and delivering fluids from the delivery source to the bag liner. The delivery source may further include a plurality of different types of fluids. A different hose connector and a different bag connector may be used for each different type of fluid The method may then further include the step of selecting the delivery hose and the bag liner depending upon the type of fluid.

A further method of the present invention provides for supplying fluids from a plurality of storage receptacles to a beverage dispenser. The method includes the steps of supplying each one of the storage receptacles with one of the bag liners. Each one of the bag liners includes one of a plurality of bag connectors. Each one of the bag connectors includes a predetermined dimension determined by the type of fluid contained within the bag liner. The method further includes the step of supplying the beverage dispenser with a plurality of delivery hoses. Each one of the delivery hoses includes one of a plurality of hose connectors. The dimensions of each one of the hose connectors are determined by the bag connectors intended to be used therewith. The method further includes the steps of selecting the bag liner to be joined with the delivery hose; connecting the bag liner with the delivery hose; and delivering fluids from one of the receptacles to the beverage dispenser Each one of the receptacles may have a different type of fluid Different bag connectors and hose connectors are used for each different type of fluid. The method may then include the steps of selecting one of the storage receptacles and one of the hose connectors depending upon the type of fluid that is to be supplied to the beverage dispenser.

It is thus an object of the present invention to provide an improved bulk storage and delivery system for soft drink syrup.

It is another object of the present invention to provide a disposable liner for use in syrup receptacles of a bulk storage and delivery system for soft drink syrup.

It is yet another object of the present invention to provide an improved bulk storage and delivery system for soft drink syrup that avoids the need for cleaning the receptacles before each refilling.

It is a further object of the present invention to provide an improved bulk storage and delivery system for soft drink syrup that avoids downtime when refilling or delivering the syrup.

It is a still further object of the present invention to provide an improved bulk storage and delivery system for soft drink syrup that prevents the inadvertent substitution of beverages to the fountain.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
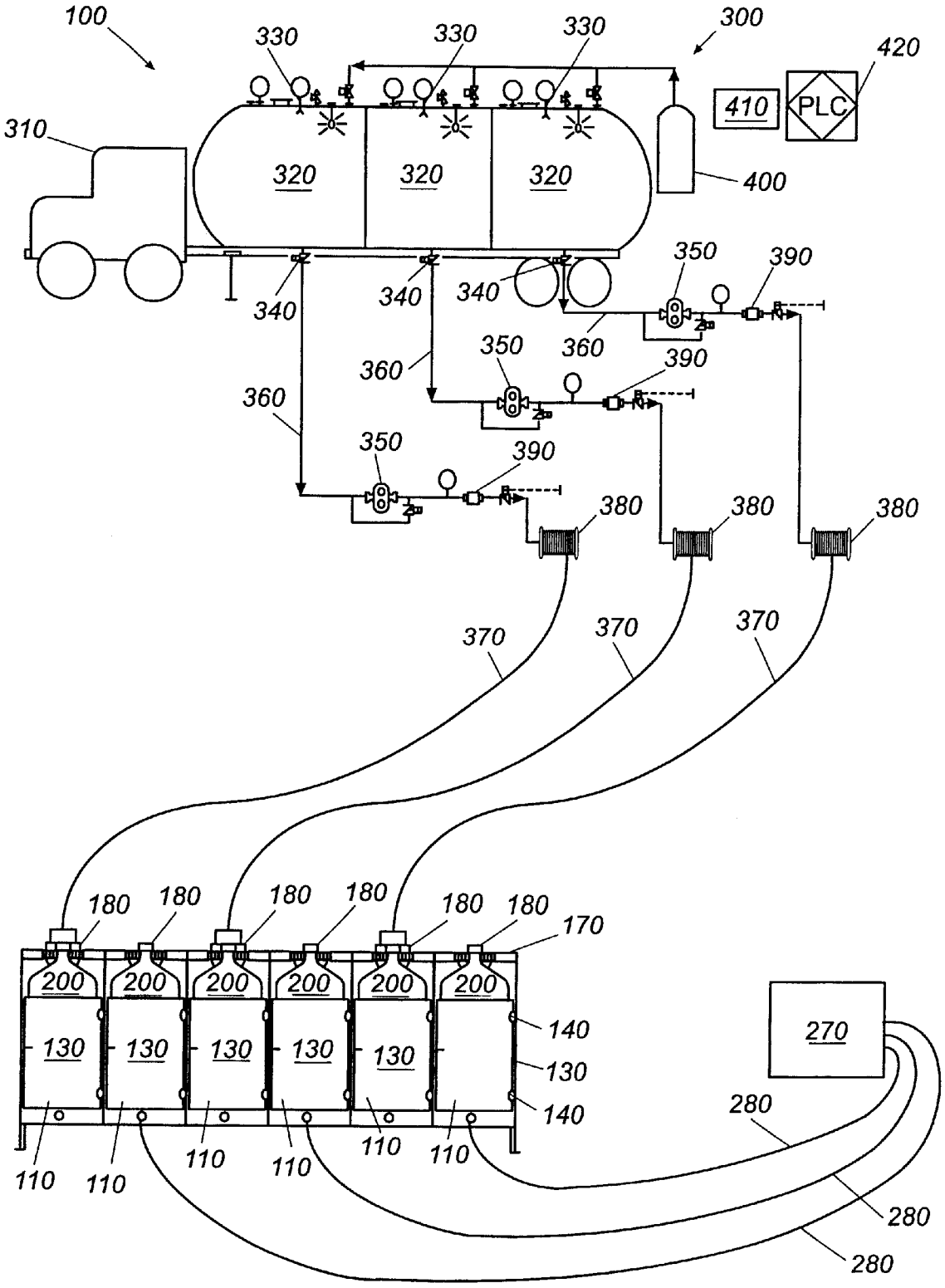
FIG. 1 is a schematic drawing of the bulk storage and delivery system of the present invention.
Figure 1A:
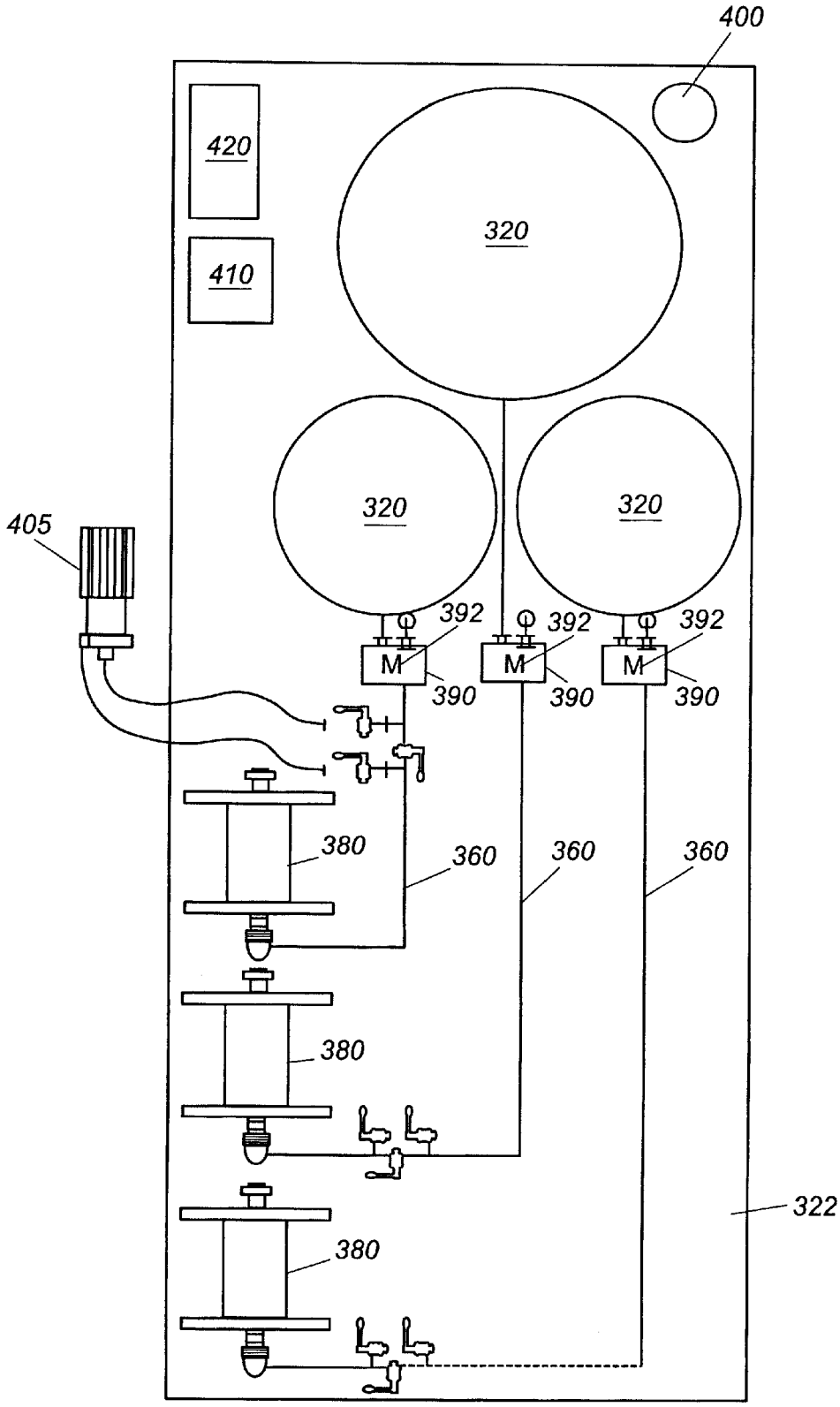
FIG. 1A is a schematic drawing of the bulk delivery system of the present invention.
Figure 2:
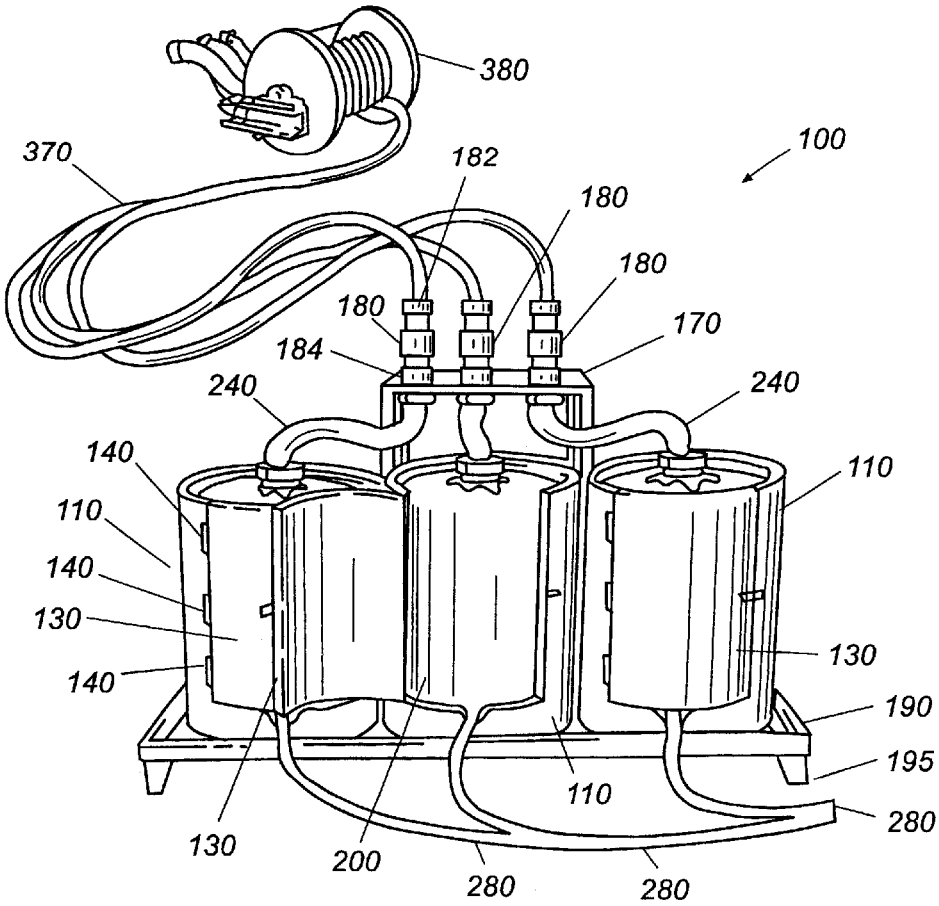
FIG. 2 is a diagrammatic view of the syrup receptacles and bags of the present invention.
Figure 3:
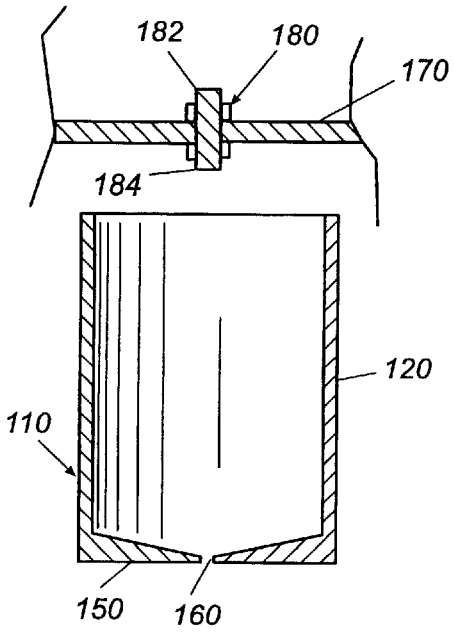
FIG. 3 is a side cross-sectional view of a syrup receptacle of the present invention.
Figure 4:
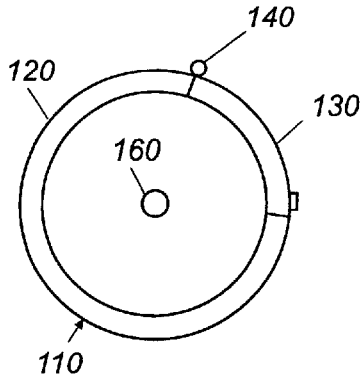
FIG. 4 is a plan view of the syrup receptacle.
Figure 5:
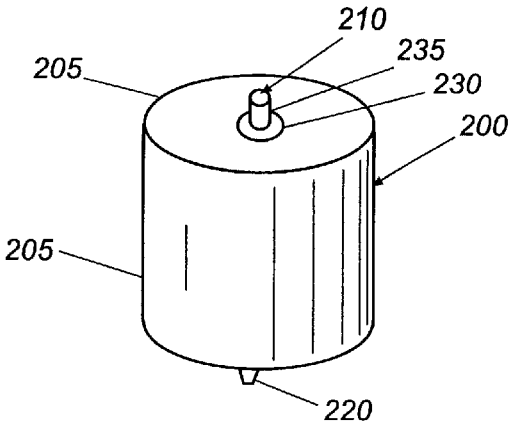
FIG. 5 is a plan view of the syrup bag.

Referring now in more detail to the drawings, in which like numerals refer to like parts throughout the several views, FIGS. 1, 1A, and 2 show a bulk syrup delivery and storage system 100 of the present invention. The bulk syrup and storage delivery system 100 includes a plurality of receptacles 110. The receptacles 110 may be stand-alone units, fixedly attached to each other, or wall mounted by conventional means. The receptacles 110 are preferably made from stainless steel, plastic, a combination of the two, or other types of substantially rigid, non-corrosive materials. The receptacles 190 may be modular in construction. Any number of receptacles 110 may be used in any formation.

The receptacles 110 each have an outer shell 120 with a door 130. The outer shell 120 may be a rounded structure or a four (4) sided structure. The door 130 is mounted by hinges 140 or by other types of conventional mechanisms to the outer shell 120. The receptacles 110 also each have a bottom plate 150. The outer shell 120 and the bottom plate 150 may be fixedly attached by conventional means or may be formed as a unitary element. The bottom plate 150 is angled slightly from the outer shell 120 towards a central drain 160. The angle is preferably about five degrees (5°) to about ten degrees (10°) so as to assist in draining syrup from the receptacle 110.

If the receptacle 110 holds about two (2) cubic feet or about fifty (50) gallons or more, the drain rate may be approximately four (4) or (5) ounces per second. The receptacle 110 may hold about fifty (50) to one-hundred (100) gallons. A combination of differently sized receptacles 110 may be used. The outer shell 120 may be of any reasonable thickness to maintain a rigid structure and to prevent puncture of the syrup container described below. The receptacles 110 may be color-coded or otherwise differentiated according to the type of syrup intended to be used therein. The receptacles 110 may have a transparent sight glass (not shown) to permit the customer to see the amount of syrup therein.

Positioned over each receptacle 110 may be a manifold 170. The manifold 170 also may be made of stainless steel or other types of substantially rigid, non-corrosive materials. The manifold 170 may have a quick release valve 180 for each receptacle. Each valve 180 may have two (2) connections, an upper connection 182 and a lower connection 184. The manifold 170 may extend across each of the receptacles 110 as is shown in FIG. 1 or may be centralized as shown in FIG. 2. The manifold 170 may be fixedly attached to the receptacles 110 or may be a self-supporting structure.

Positioned under each receptacle 110 may be a load cell 190. The load cell 190 may be of conventional design. The load cell 190 allows the customer to measure accurately the amount of syrup added to and drained from the receptacles 110. The receptacles 110 also may be mounted on to a skid 195 so as to provide containment for syrup spills. The receptacles 190 may be removable to permit access.

Positioned within each receptacle 110 is a syrup bag 200. Each syrup bag 200 may be made from conventional, substantially nonpermeable materials, such as those used in bags for known bag in box formats. For example, the bag 200 may have two (2) or more walls 205 that are heat-sealed together or otherwise joined by conventional methods. The walls 205 may each have one (1) or two (2) plys of a polyethylene resin. For example, an inner ply made from a web of two (2) mil Linear Low Density Polyethylene ("LLDPE") or similar materials and an outer ply of a four (4) mil co-extrusion layer of LLDPE/Nylon/LLDPE, with tie layers on either side of the nylon, or similar materials. The two (2) LLDPE layers are preferably about 1.4 mil, the nylon about 1.0 mil and the tie layers about 0.1 mil. The bags 200 are preferably made from disposable and recyclable materials.

The bags 200 also have two (2) spouts, an upper spout 210 and a lower spout 220. The spouts 210, 220 are of conventional design and meet applicable industry tamper evident requirements. Each spout 210, 220 preferably has a flange 230 surrounding a cylindrical body 235. The flange 230 is heat sealed to the bag walls 205 for a fluid tight seal. The spouts 210, 220 may be identical in design to those used in known BIB bags. If the spouts 210, 220 are similar in design to known BIB bags, a BIB bag can be used as a reserve in the event that one of the bags 200 of the present invention is exhausted. Each bag 200 preferably evacuates S to approximately one (1) ounce or less over five (5) gallons. In fact, less than three (3) ounces may remain over fifty (50) gallons. Because the fill time of the bag 200 can be much faster than its drain time, the upper spout 210 may be larger in diameter than the lower spout 220. For example, the fill time of the bag 200 may be approximately twenty (20) gallons per minute while the drain time may be approximately four (4) to five (5) ounces per second. As such, the upper spout 210 may have a diameter of about two (2) to three (3) inches while the lower spout 220 may have a diameter of only about one (1) to two (2) inches.

Figure 6:
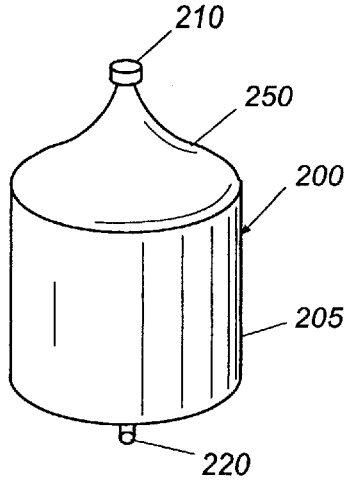
FIG. 6 is a plan view of an alternative syrup bag.

The bag 200 is preferably sized to fit within the receptacle 110. For example, the bag 200 may hold about (50) to one-hundred (100) gallons of syrup depending upon the size of the receptacle 110. Although the term "syrup" is used herein, it should be noted that any type of fluid may be used. Variously sized receptacles 110 with correspondingly sized bags 200 may be used. The bag 200 may connect to the manifold 170 via a hose 240 as is shown in FIG. 2 or the bag 200 itself may have an upper cone shaped section 250 such that the bag 200 attaches directly to the manifold 170. An example of a bag 200 with a cone shaped section 250 is shown in FIG. 6. In either scenario, the manifold 170 supports the bag 200 as the bag 200 drains so as to prevent the bag 200 from collapsing upon itself and blocking the lower spout 220. The bag 200 also may be color-coded or otherwise differentiated according to the type of syrup to be used therein. A possible bag design for use in this delivery and storage system 100 may be similar to that disclosed in U.S. Pat. No. 4,596,040 to Lafleur, et al., owned by Custom Packaging Systems of Maistee, Mich. The disclosure of U.S. Pat. No. 4,596,040 is incorporated herein by reference.

Each bag 200 also is connected to a conventional fountain system 270 via a fountain hose 280. Each bag 200 is connected to the fountain system 270 by a separate fountain hose 280. The fountain hose 280 mates with the lower spout 220 of each bag 200 through the central drain 160 of the receptacle 110. The syrup is supplied to the fountain system 270 from the bag 200 by a pump, by gravity, or by other conventional transport means. The fountain hoses 280 also may be color-coded or otherwise differentiated according to the type of syrup to be used therein.

Syrup is delivered to the receptacles 110 by a tanker system 300. The tanker system 300 includes a delivery vehicle 310, preferably with a plurality of tanks or compartments 320. Each compartment 320 may hold approximately 500 to 1000 gallons of syrup therein. The compartments 320 may be mounted on a skid 322 such that a dedicated vehicle is not required. A conventional intermediate bulk container also may be used. In the example of FIG. 1, each compartment 320 has a fill port 330 and a drain port 340. Each compartment 320 may be drained via a drain hose 360 connected to the drain port 340. The drain hose 360 is preferably about 1.5 inches in diameter.

The delivery vehicle 310 also may have a compressed gas source 400 mounted thereon. The compressed gas source 400, such as carbon dioxide, nitrogen, or compressed air, may be used to provide, i.e., push, the syrup out of the compartments 320 to the receptacles 110. A compressed gas booster pump 405 also may be used. The compartments 320 may be pressurized by up to about thirty (30) pounds per square inch. The compressed gas source 400 also may be used to blow the compartments 320 and the drain hoses 360 clean after the compartments 320 are evacuated. Alternatively, the syrup in each compartment 320 may be drained via a pump 350. The pump 350 is of conventional design. The pump 350 preferably can force approximately twenty-five (25) gallons per minute from the compartments 320.

Each drain hose 360 leads a truck manifold 390. The truck manifold 390 also may contain a meter 392 to determine the amount of syrup delivered. Any type of mechanical or electrical meter 392 may be used. The meter 392 may be positioned at any convenient location. Mounted onto the truck manifold 390 is a plurality of hose reals 380. A delivery hose 370 is positioned on each hose real 380 for easy access and delivery of the syrup. Each delivery hose 370 mates with a valve 180 on the tank manifold 170. The delivery hoses 370 also may be color-coded or otherwise differentiated according to the type of syrup to be used therein. The delivery hoses 370 may be about 1.5 inches in diameter. The delivery hoses 370 may be approximately 100 feet long or longer depending upon the location of the receptacles 110 and their accessibility.

The delivery vehicle 310 also may have a ticket printer 410 operated by a conventional programmable logic card or controller 420 so as to provide invoices and maintain various types of use and inventory information. The controller 420 may receive information from the meter 392 or other sources. The controller 420 may monitor the amount of syrup dispensed with accuracy of about plus or minus 0.15 percent. The amount of syrup delivered to the receptacles 110 may be varied.

Figure 7:
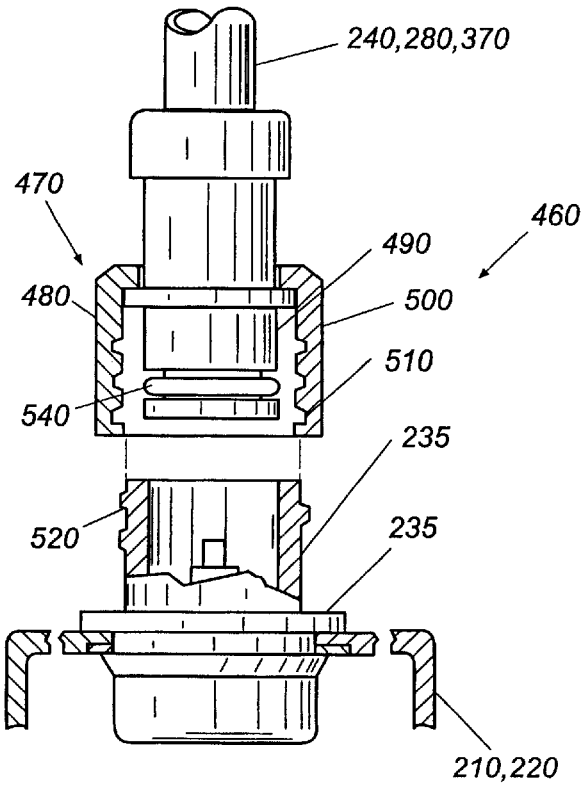
FIG. 7 is a side cross-sectional view of a hose connection.
Figure 8:
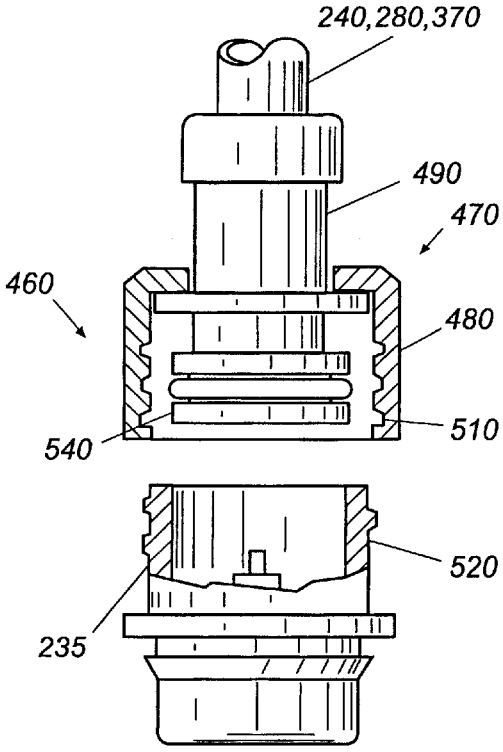
FIG. 8 is a side cross-sectional view of an alternative hose connection.

FIGS. 7 and 8 show examples of two different spout connectors 460 that may be used with the bulk syrup delivery system 100 of the present invention. The spout connectors 450 may be used in several different locations. The spout connectors 450 could be used between the delivery hose 370 and the valve 180 of the tank manifold 170, between the valve 180 of the tank manifold 170 and the upper spout 210 of the bag 200, and between the lower spout 220 of the bag 200 and the fountain hose 280 of the fountain system 270. The spout connectors 450 prevent the wrong type of syrup from being delivered to the wrong bag 200 or from being drained from the bag 200 to the fountain system 270. Preferably, each different type or flavor of syrup would have a different type of spout connector 450.

FIG. 7 shows a quick disconnect connector 460 having a coupling 470 selectively connectable to the spouts 210, 220 of the bag 200. The coupling 470 is mounted on one end of the hoses 240, 280, or 370. The coupling 470 includes a sleeve 480 slidably and rotatably mounted on a central core 490. The inside of the sleeve 480 is radially spaced from the central core 490 to define an annular region 500 between the central core 490 and the inner surface of the sleeve 480. The central core 490 includes a hollow interior passage connected in flow relation to the hose 240, 280, or 370. Threads 510 are formed on the inner surface of the sleeve 480.

The spouts 210, 220 also have threads 520 formed on the cylindrical body 235. The spout threads 520 match the threads 510 of the coupling 470. When the connector is coupled to the spouts 210, 220, the central core 490 fits in the annular region 500 and an O-ring seal 540 near the lower end of the central core 490 engages the inner wall of the cylindrical body 235. FIG. 8 shows a similar connector 460 with the connector 470 having a larger sleeve 480 and a larger central core 490. Likewise, the spout 210, 220 has a larger cylindrical body 235. Because of this size difference, the coupling 470 of FIG. 7 will not mate with the spout 210, 220 of FIG. 8 and vice versa.

In use, the customer may have two (2) or more receptacles 110 for each fountain hose 280 connected to the fountain system 270. This dual receptacle arrangement allows the customer to use one receptacle 110 while leaving the other receptacle 110 available to be refilled. By using the receptacles 110 in this alternating fashion, there is no down time or lack of availability at the fountain system 270. In the bulk syrup delivery system 100 of FIG. 2, the customer is using at least three (3) different sources of syrup, $S_1$, $S_2$, and $S_3$ and therefore uses six (6) receptacles 110, two (2) for syrup $S_1$, two (2) for syrup $S_2$, and two (2) for syrup $S_3$.

Likewise, the tanker system 300 is also designed to deliver the same three (3) types of syrup, $S_1$, $S_2$, and $S_3$. Each compartment 320 on the delivery vehicle 310 may contain a different type of syrup. When the delivery vehicle 310 arrives at the customer's location, the delivery worker determines the type and volume of syrup needed. Alternatively, an electronically managed inventory system may be used to determine need and to facilitate route planning.

The delivery worker installs new bags 200 in the receptacles 110 that are not currently hooked up to the fountain hoses 280 of the fountain system 270. The delivery worker matches the color of the bag 200 with the color of the receptacle 110. The delivery worker places the correct bag 200 within the receptacle 110 and either attaches a new hose 240 to the upper spout 210 of the bag 200 and to the valve 180 of the manifold 170 or directly attaches the upper spout 210 to the valve 180 of the manifold 170. The worker unwinds the matching colored delivery hose 370 from the reel 380 attached to the delivery vehicle 310. The delivery hose 370 is attached to the valve 180 of the manifold 170. The delivery worker then activates the pumps 350 or the compressed gas source 400 and fills the receptacle 110 with syrup. The amount and type of syrup to be delivered may be programmed at the controller 420. The amount of syrup dispensed also is metered so as to shut off the pumps 350 or the compressed gas source 400 after the appropriate amount of syrup has been delivered. This process is then repeated for the remaining receptacles 110 not connected to the fountain system 270. In this example, three (3) types of syrup may be dispensed at once from the tanker system 300.

Because of the use of the connectors 460, syrup $S_1$ from the delivery vehicle 310 can only be delivered to the receptacle 110 also marked for syrup $S_1$. The matching color scheme also reduces the possibility that the wrong type of syrup would be delivered to the wrong bag 200. After the receptacles 110 are full, the delivery worker then reels in the delivery hose 370 on the reel 380. The bags 200 are then sealed with a tamper evident cover. The controller 420 accurately meters the amount of syrup delivered. The ticket printer 410 may then print out an invoice for the customer. Likewise, the load cell 190 may automatically transmit this information directly to the controller 420 or elsewhere. The load cell 190 also accurately provides information on the amount of syrup delivered and consumed.

When the syrup in the receptacle 110 is exhausted, the customer merely disconnects the fountain hose 370 from the exhausted bag 200 and connects the fountain hose 370 to a bag 200 in a filled receptacle 110. Again, because of the use of the connectors 450, the customer cannot connect the hose 370 to the incorrect bag 200. Likewise, the use of matching colors on the receptacle 110, the bag 200, and the fountain house 370 reduces the possibility that the wrong type of syrup would be delivered to the wrong bag 200. The syrup is then drained through the lower spout 220 of the bag 200 and into the fountain hose 280 of the fountain system 270.

The syrup is then mixed with a diluent such as soda water in a conventional fashion and served to a consumer. The exhausted bag 200, and the hose 240 if used, are removed from the receptacle 110 by the customer or the delivery worker. The bag 200 is then discarded or recycled.

The present invention thus results in a number of advantages over known delivery and storage means. For example, as compared to known BIB containers, the present invention results in less product remaining in the bag (less than one (1) ounce over five (5) gallons), eliminates the need for the corrugated boxes, and eliminates the need to lift the boxes. The present invention also provides the ability to deliver a varied amount of syrup as opposed to known method that always push 75 gallons into known receptacles. Further, the modularity of the present invention addresses the problem of limited storage space.

It should be apparent that the foregoing relates only to a preferred embodiment of the present invention and that numerous changes and modifications may be made without departing from the spirit and scope of the invention as defined by the following claims.

We claim:

1. An improved bulk storage system for fluids supplied to a dispensing system by a line, comprising:

a receptacle;

said receptacle comprising a first portal and a second portal;

a substantially nonpermeable bag positioned within said receptacle for storing and dispensing fluids therefrom;

said bag comprising a first passageway positioned adjacent to said first portal of said receptacle and a second passageway positioned adjacent to said second portal of said receptacle;

a support device positioned adjacent to said receptacle;

said first passageway of said bag attached to said support device; and said second passageway of said bag attached to said line such that fluids in said bag flow through said second passageway to said dispensing system.

2. The improved bulk storage system of claim 1, wherein said receptacle comprises an outer shell.

3. The improved bulk storage system of claim 2, wherein said outer shell comprises a first end and a second end.

4. The improved bulk storage system of claim 3, wherein said first portal comprises said first end of said outer shell.

5. The improved bulk storage system of claim 2, wherein said second end of said receptacle comprises a bottom plate.

6. The improved bulk storage system of claim 5, wherein said second portal comprises said central drain positioned within said bottom plate.

7. The improved bulk storage system of claim 1, wherein said receptacle comprises stainless steel.

8. The improved bulk storage system of claim 1, wherein said bag comprises a flexible material.

9. The improved bulk storage system of claim 1, wherein said bag comprises linear low density polyethylene.

10. The improved bulk storage system of claim 1, wherein said first passageway comprises a spout attached to said bag.

11. The improved bulk storage system of claim 10, wherein said first passageway comprises a hose connected to said spout.

12. The improved bulk storage system of claim 1, wherein said first passageway comprises an extended bag section.

13. The improved bulk storage system of claim 1, wherein said second passageway comprises a spout.

14. The improved bulk storage system of claim 1, wherein said support device comprises a manifold.

15. The improved bulk storage system of claim 14, wherein said manifold comprises a first valve and a second valve and wherein said first valve and said second valve are in fluid communication with each other.

16. The improved bulk storage system of claim 15, wherein said first passageway of said bag is attached to said second valve of said manifold such that fluids flowing through said first valve of said manifold pass through said second valve and said first passageway into said bag.

17. The improved bulk storage system of claim 16, wherein said first passageway comprises a first passageway connector, said first passageway connector comprising a predetermined size.

18. The improved bulk storage system of claim 17, wherein said second valve of said manifold comprises a manifold connector, said manifold connector comprising said predetermined size.

19. The improved bulk storage system of claim 18, wherein said predetermined size varies with the type of fluid intended to be placed in said bag.

20. The improved bulk storage system of claim 1, wherein said line comprises a line connector, said line connector comprising a predetermined size.

21. The improved bulk storage system of claim 20, wherein said second passageway comprises a passageway connector, said passageway connector comprising said predetermined size.

22. The improved bulk storage system of claim 20, wherein said predetermined size varies with the type of fluid intended to be dispensed from said bag.

23. The improved bulk storage system of claim 1, wherein said bag comprises a predetermined color, said predetermined color depending upon the type of fluid intended to be contained in said bag.

24. The improved bulk storage system of claim 23, wherein said receptacle comprises said predetermined color.

25. The improved bulk storage system of claim 23, wherein said line comprises said predetermined color.

26. The improved bulk storage system of claim 1, further comprising a delivery system for providing fluids to said bag through said first passageway.

27. The improved bulk storage system of claim 26, wherein said delivery system comprises a delivery vehicle with a plurality of fluid compartments.

28. The improved bulk storage system of claim 27, wherein said delivery system comprises a delivery hose for providing fluids from one of said plurality of fluid compartments to said bag.

29. The improved bulk storage system of claim 28, wherein said support device comprises a manifold such that said delivery hose and said first passageway of said bag are connected in fluid communication through said manifold.

30. The improved bulk storage system of claim 29 wherein said delivery hose comprises a delivery hose connector, said delivery hose connector comprising a predetermined size.

31. The improved bulk storage system of claim 30, wherein said manifold comprises a manifold connector, said manifold connector comprising said predetermined size.

32. The improved bulk storage system of claim 31, wherein said predetermined size varies with the type of fluid intended to be delivered to said bag.

33. The improved bulk storage system of claim 28, wherein said delivery hose comprises a predetermined color, said predetermined color depending upon the type of fluid intended to be placed in said bag.

34. A method for using a storage receptacle with a beverage dispenser, said storage receptacle and said beverage dispenser connected by a fluid line, said method comprising the steps of:

placing a flexible bag within said storage receptacle;

said flexible bag comprising a first spout and a second spout;

said first spout comprising a first diameter, said second spout comprising a second diameter, and wherein said first diameter is greater than said second diameter;

attaching said second spout to said fluid line;

supplying fluids to said bag through said first spout at a first volume;

evacuating fluids from said bag to said beverage dispenser through said second spout and said fluid line at a second volume;

wherein said first volume is greater than said second volume; and removing said bag from said receptacle when said bag is exhausted.

35. The method of claim 34, wherein said fluid comprises soft drink syrup.

36. The method of claim 34, wherein said receptacle comprises a manifold positioned adjacent thereto, said method further comprising the steps of attaching said first spout to said manifold and supplying fluids to said bag through said manifold.

37. A method for using a plurality of color-coded storage receptacles for supplying a plurality of syrups to a beverage dispenser, each of said plurality of color-coded receptacles to be lined with one of a plurality of color-coded bags and connected to said beverage dispenser by one of a plurality of color-coded fluid lines, said method comprising the steps of:

selecting one of said plurality of color-coded receptacles;

selecting one of said plurality of color-coded bags to match said color-coded receptacle;

placing said color-coded bag within said color-coded receptacle;

filling said color-coded bag with one of said plurality of syrups corresponding to said color-coded bag and said color-coded receptacle;

selecting said one of said plurality of color-coded fluid lines to match said color-coded receptacle and said color-coded bag;

connecting said color-coded bag to said color-coded fluid line; and supplying said one of said plurality of syrups to said beverage dispenser.

38. The method of claim 37, further comprising a delivery vehicle, said delivery vehicle comprising a plurality of fluid compartments and a plurality of color-coded delivery hoses.

39. The method of claim 38, wherein said method further comprises the steps of:

selecting one of said plurality of color-coded delivery hoses to match said color-coded receptacle and said color-coded bag; and connecting said color-coded delivery hose to said color-coded bag.

40. A method for supplying fluids from a delivery source to a plurality of storage receptacles, said method comprising the steps of:

providing each one of said plurality of storage receptacles with one of a plurality of bag liners, each one of said plurality of bag liners comprising one of a plurality of bag connectors, each one of said plurality of bag connectors comprising a predetermined dimension determined by the type of fluid to be placed within said bag liner;

providing said delivery source with a plurality of delivery hoses, each one of said plurality of delivery hoses comprising one of a plurality of hose connectors, each one of said plurality of hose connectors comprising a predetermined dimension determined by said one of said plurality of bag connectors intended to be used therewith;

selecting one of said bag liners within one of said plurality of receptacles to be joined with said one of said delivery hoses;

connecting said one of said bag liners with said one of said delivery hoses via said one of said plurality of bag connectors and said one of said plurality of said hose connectors; and delivering fluids from said delivery source to said bag liner within said one of said plurality of receptacles.

41. The method of claim 40, wherein said delivery source comprises a plurality of different types of fluids and wherein a different one of said plurality of said hose connectors is used for each one of said plurality of different types of fluids.

42. The method of claims 41, further comprising the step of selecting said one of said plurality of delivery hoses depending upon which one of said plurality of different types of fluids is in communication therewith.

43. The method of claim 42, wherein a different one of said plurality of bag connectors is used for each one of said plurality of said different types of fluids.

44. The method of claim 43, further comprising the step of selecting said one of said plurality of bag liners depending upon which one of said plurality of different types of fluids are to be supplied to said bag liner within said one of said plurality of receptacles.

45. A method for supplying fluids from a plurality of storage receptacles to a beverage dispenser, said method comprising the steps of:

providing one each of said plurality of storage receptacles with one of a plurality of bag liners, each one of said plurality of bag liners comprising one of a plurality of bag connectors, each one of said plurality of bag connectors comprising a predetermined dimension determined by the type of fluid to be contained within said bag liner;

providing said beverage dispenser with a plurality of delivery hoses, each one of said plurality of delivery hoses comprising one of a plurality of hose connectors, each one of said plurality of hose connectors comprising a predetermined dimension determined by said one of said plurality of bag connectors intended to be used therewith;

selecting one of said bag liners within one of said plurality of receptacles to be joined with said one of said delivery hoses;

connecting said one of said bag liners with said one of said delivery hoses via said one of said plurality of bag connectors and said one of said plurality of said delivery hose connectors; and delivering fluids from said one of said plurality of bag liners within said one of said plurality of receptacles to said beverage dispenser.

46. The method of claim 45, wherein each one of said plurality of storage receptacles comprises a different type of fluid and wherein a different one of said plurality of said bag connectors is used for each one of said different type of fluid.

47. The method of claims 46, further comprising the step of selecting said one of said plurality of storage receptacles depending upon which one of said different type of fluid is contained therein.

48. The method of claim 47, wherein a different one of said plurality of hose connectors is used for each one of said different type of fluid.

49. The method of claim 48, further comprising the step of selecting said one of said plurality of hose connectors depending upon which one of said different type of fluid is to be supplied to said beverage dispenser.

* * * * *